US008757057B1

(12) United States Patent
Olds

(10) Patent No.: US 8,757,057 B1
(45) Date of Patent: Jun. 24, 2014

(54) BALING MACHINE

(75) Inventor: Emory Olds, Cordele, GA (US)

(73) Assignee: Sierra International Machinery, LLC, Bakersfield, CA (US)

( * ) Notice: Subject to any disclaimer, the term of this patent is extended or adjusted under 35 U.S.C. 154(b) by 0 days.

(21) Appl. No.: 12/572,382

(22) Filed: Oct. 2, 2009

Related U.S. Application Data

(60) Provisional application No. 61/172,647, filed on Apr. 24, 2009.

(51) Int. Cl.
*B30B 9/30* (2006.01)

(52) U.S. Cl.
USPC ..... 100/245; 100/350; 100/215; 100/218; 100/232

(58) Field of Classification Search
USPC ..... 100/3, 178, 179, 214, 215, 218, 232, 100/240, 242, 245, 901, 350
See application file for complete search history.

(56) References Cited

U.S. PATENT DOCUMENTS

| | | | | | |
|---|---|---|---|---|---|
| 3,003,411 | A | * | 10/1961 | Judd | 100/98 R |
| 3,762,311 | A | * | 10/1973 | Friedman et al. | 100/49 |
| 4,108,063 | A | * | 8/1978 | Randolph | 100/352 |
| 4,318,682 | A | | 3/1982 | Larson et al. | |
| 4,417,510 | A | | 11/1983 | Sharp | |
| 4,729,301 | A | * | 3/1988 | Smith et al. | 100/43 |
| 4,936,206 | A | | 6/1990 | Miles et al. | |
| 5,088,399 | A | | 2/1992 | Cacace et al. | |
| 5,247,881 | A | | 9/1993 | Rosser et al. | |
| 5,363,757 | A | | 11/1994 | Newsom | |
| 5,566,610 | A | | 10/1996 | Robinson et al. | |
| 5,611,268 | A | | 3/1997 | Hamilton | |
| 6,729,229 | B1 | | 5/2004 | Wildes et al. | |
| 2003/0201140 | A1 | * | 10/2003 | Pierre et al. | 187/254 |
| 2003/0226456 | A1 | | 12/2003 | Simpson | |

* cited by examiner

*Primary Examiner* — Jimmy T Nguyen
(74) *Attorney, Agent, or Firm* — Knobbe Martens Olson & Bear LLP

(57) ABSTRACT

A baling machine having a hold down assembly. The hold down assembly inhibits the baling ram from moving vertically beyond a desired vertical position. The hold down assembly includes at least one hold down member that is coupled to the frame of the baling machine via a shim assembly and a friction bolt assembly that allows for vertical positioning of the at least one hold down member with respect to the frame of the baling machine.

15 Claims, 6 Drawing Sheets

BALING MACHINE

RELATED APPLICATIONS

This application claims the benefit of U.S. Provisional Application No. 61/172,647, filed Apr. 24, 2009, entitled BALING MACHINE, which is hereby incorporated in its entirety by reference herein.

BACKGROUND OF THE INVENTION

1. Field of the Invention

The present invention relates to an apparatus or machine for baling bulk material, such as scrap metal, into a bale for easier transport and, in particular, concerns a baling machine that is easily adjustable to accommodate wear between the ram and the frame of the baling machine.

2. Description of the Related Art

Material waste processing such as scrap metal processing is a well-known form of processing. Generally, bulk quantities of scrap material, such as scrap metal are positioned into a rectangular chamber and are then compressed into a bale shape by a hydraulic ram. In this way, discrete pieces of waste materials are then formed into a cohesive element that is easier to store and to transport for further processing.

Typically, a horizontal baler has a hopper into which the waste material is deposited. The hopper then feeds into an opening that leads to the compression chamber. The compressing ram then travels into the compression chamber sealing off the opening and the hopper. Typically, the compressing ram and the edge of the opening adjacent the compression chamber define a cutting apparatus that cuts through waste material that extends out of the opening into the hopper.

One difficulty that occurs with horizontal waste processing baling devices is that there are significant forces being exerted between the ram and the compression chamber to compress the waste material. These significant forces result in greater frictional forces between the bottom surface of the ram and the interior of the main body of the waste material baling machine. These frictional forces ultimately will wear away the surfaces at the interface between the bottom of the ram and the main body of the baling machine.

Once these surfaces are worn, the ram can move vertically with respect to the bottom surface of the main body of the baling machine. Scrap metal can then be forced into the interface between the main body of the ram during the compression stroke which can cause the ram to either jam or move vertically upward during the compression stroke. If the ram moves vertically upward during the compression stroke, it is possible that the cutting surface of the ram will collide with the cutting surface on the main body adjacent the opening, either jamming the baling machine or potentially damaging the cutting apparatus. In either circumstance, a loss of productivity and increased operating and/or repair costs may be incurred.

To address this issue, waste material baling machines have been developed where the position of the ram in the main body or compression chamber can be fixed. Often, these waste material baling machines allow for adjustability to accommodate the wear that is occurring between the ram and the main body. However, prior art designs are often expensive and cumbersome for operators to manipulate.

One example of a prior art baling device is shown in U.S. Pat. No. 5,247,881 to Rosser et al. Rosser includes an apparatus that limits the vertical movement of the ram. However, the vertical adjustment mechanism requires the use of preformed components which are more expensive. Further, in Rosser, vertical adjustment is achieved by loosening a pair of bolts, and then tightening and/or loosening a third bolt until a desired vertical level is achieved. This requires the user of the Rosser baler to essentially guess the desired vertical position of the apparatus which can be time consuming and can further result in additional jams of the baler or damage to the cutting surface if the operator has guessed the wrong vertical adjustment of the apparatus.

From the foregoing, it will be appreciated that there is a need for a waste material baler that includes a vertical adjustment apparatus that inhibits jams and damage to the cutting apparatus which is cheaper and easier to use. To this end, there is a need for an adjustment mechanism which is self aligning and also does not require pre-formed specially shaped materials.

SUMMARY OF THE INVENTION

The aforementioned needs are satisfied by the present invention which, in one implementation comprises a baling machine for baling uncompressed waste material, the baling machine comprising a baling ram housing defining an opening wherein the baling ram housing includes a charging chamber and a compaction chamber and wherein the charging chamber includes an opening whereby uncompressed waste material can be introduced into the charging chamber. The baling machine further comprises a baling ram assembly having a baling ram positioned within the housing, wherein the baling ram urges uncompressed material from the charging chamber into the compaction chamber so as to compress the uncompressed material into a bale and wherein the baling ram. The baling machine further comprises a hold down assembly positioned adjacent the opening of the charging chamber, wherein hold down assembly inhibits the baling ram from moving vertically upward in the charging chamber wherein the hold down assembly includes at least one hold down member that is coupled to the baling ram housing so as to be vertically adjustable with respect to the baling ram housing and wherein the at least one hold down member is coupled to the baling housing via at least one shim assembly and a friction bolt assembly which are arranged so that removal of shims from the shim assembly allows the at least one hold down member to be positioned in a first position adjacent the baling ram when the baling ram is in the charging chamber so that the friction bolt assembly can be tightened to secure the at least one hold down member in the first position.

In another aspect, the aforementioned needs are satisfied by a baling machine for baling uncompressed waste material, the baling machine comprising a baling ram housing defining an opening wherein the baling ram housing includes a charging chamber and a compaction chamber and wherein the charging chamber includes an opening whereby uncompressed waste material can be introduced into the charging chamber. The baling machine further comprises a baling ram assembly having a baling ram positioned within the housing, wherein the baling ram urges uncompressed material from the charging chamber into the compaction chamber so as to compress the uncompressed material into a bale and wherein the baling ram. The baling machine further comprises a hold down assembly positioned adjacent the opening of the charging chamber, wherein hold down assembly inhibits the baling ram from moving vertically upward in the charging chamber wherein the hold down assembly includes at least one hold down member that is coupled to the baling ram housing so as to be vertically adjustable with respect to the baling ram housing and wherein the at least one hold down member is coupled to the baling housing via at least one shim assembly and a friction bolt assembly which are arranged so that removal of shims from the shim assembly allows the at least one hold down member to be positioned so as to rest on the baling ram when the baling ram is in the charging chamber so that the friction bolt assembly can be tightened to partially secure the at least one hold down member in the first position and wherein shims can be selectively positioned into the shim assembly to retain the at least one hold down member in the first position.

In another aspect, the aforementioned needs are satisfied by a hold down assembly for a baling machine for baling uncompressed waste material, the baling machine having a baling ram housing defining an opening wherein the baling ram housing includes a charging chamber and a compaction chamber and wherein the charging chamber includes an opening whereby uncompressed waste material can be introduced into the charging chamber and a baling ram assembly having a baling ram positioned within the housing, wherein the baling ram urges uncompressed material from the charging chamber into the compaction chamber so as to compress the uncompressed material into a bale and wherein the baling ram. In this aspect, the hold down assembly is positioned adjacent the opening of the charging chamber, wherein hold down assembly inhibits the baling ram from moving vertically upward in the charging chamber. In this aspect, the hold down assembly includes at least one hold down member that is coupled to the baling ram housing so as to be vertically adjustable with respect to the baling ram housing and wherein the at least one hold down member is coupled to the baling housing via at least one shim assembly and a friction bolt assembly which are arranged so that removal of shims from the shim assembly allows the at least one hold down member to be positioned in a first position adjacent the baling ram when the baling ram is in the charging chamber so that the friction bolt assembly can be tightened to secure the at least one hold down member in the first position.

These and other objects and advantages will become more apparent from the following description taken in conjunction with the accompanying drawings.

DETAILED DESCRIPTION OF THE PREFERRED EMBODIMENT

Figure 1A:
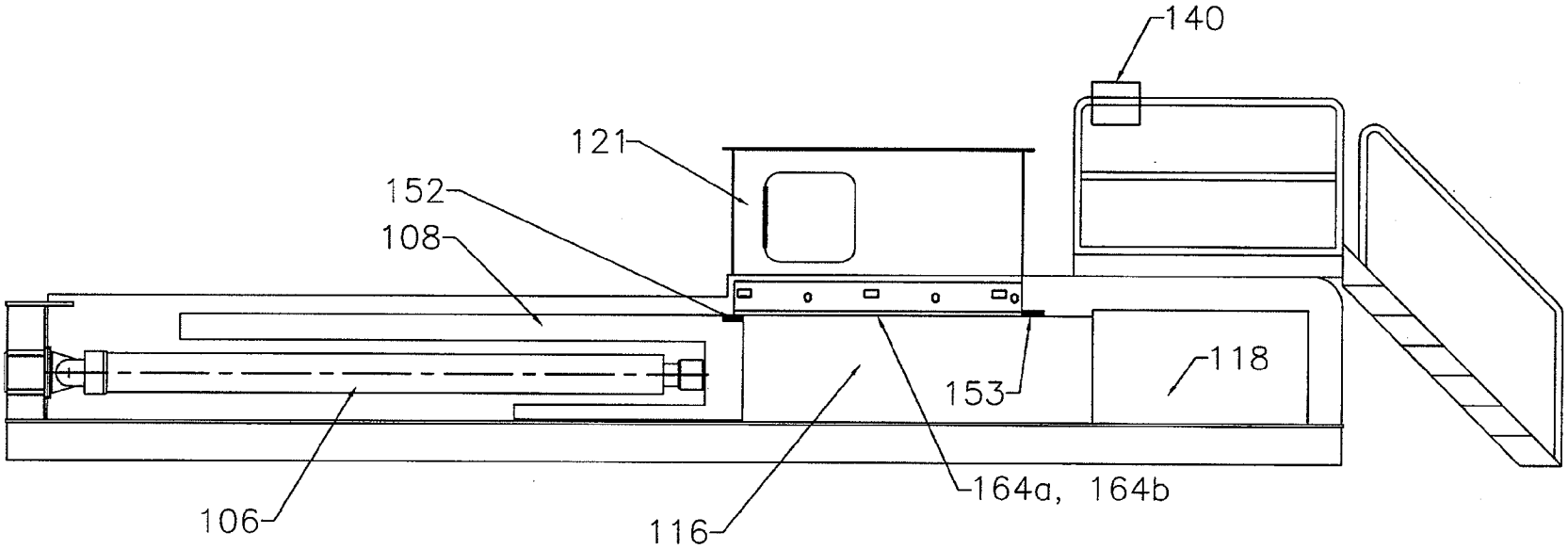
FIGS. 1A and 1B are simplified side and top diagram illustrating a typical waste material baler in which a vertical adjustment mechanism can be implemented.
Figure 1B:
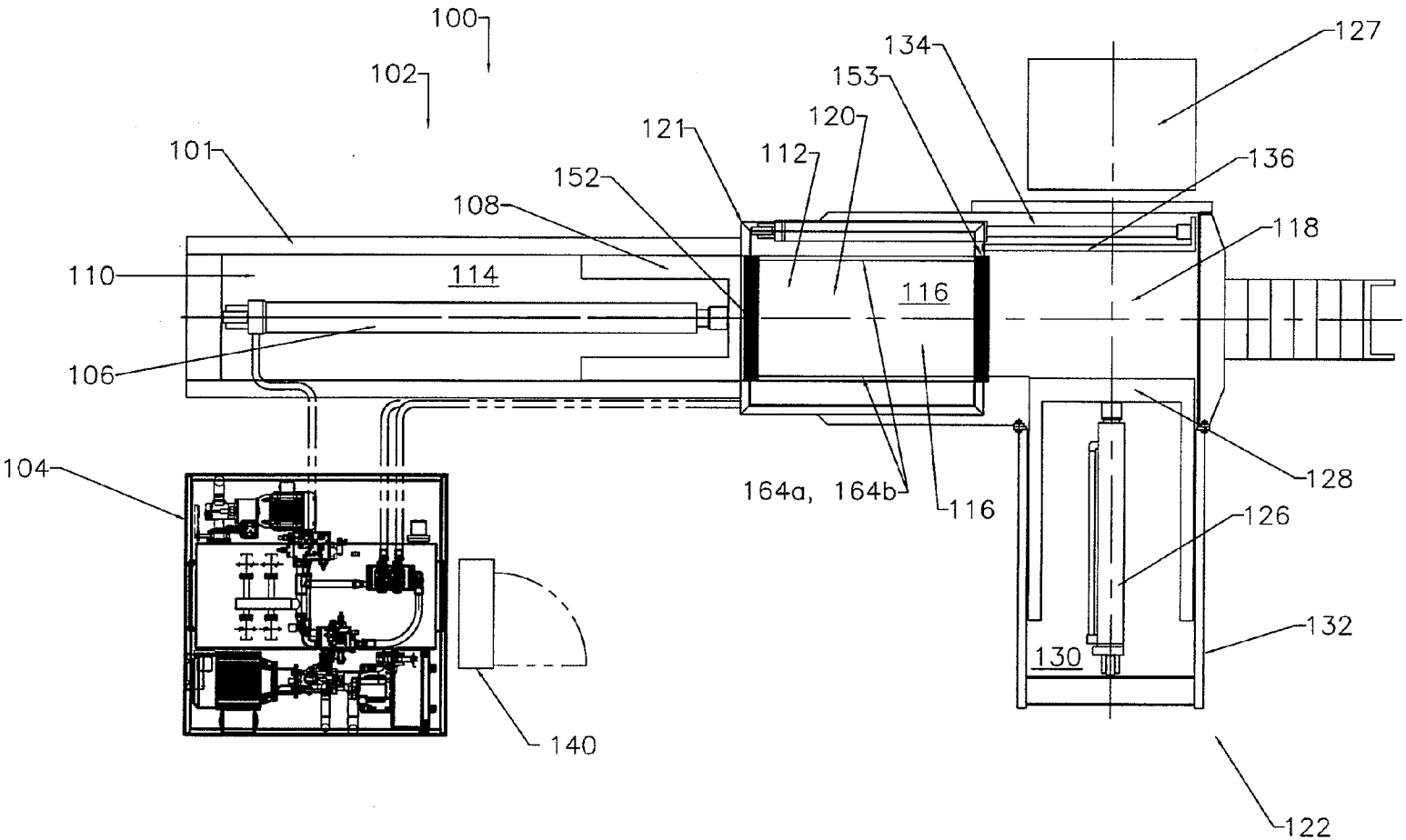

Reference will now be made to the drawings wherein like numerals refer to like parts throughout. FIGS. 1A and 1B are simplified schematic illustrations of a typical waste material baler 100. As shown, the waste material baler 100 includes baler frame 101 with a main ram assembly 102 that has a hydraulic power unit 104 that actuates a linear actuator 106 to move a baling ram 108 through a first elongate opening 110 in a main housing 112 of the baler 100. The main housing 112 is generally elongate and defines the elongate opening 110 with a generally rectangular cross-section. Preferably, the baling ram 108 is also rectangular in cross-section having dimensions that substantially match the dimensions of the elongate opening 110.

The elongate opening 110 defines the path of travel of the baling ram 108 and is divided into sections. One section includes a main ram travel section 114 wherein the piston 106 and the motor 104 is located. Another section of the elongate opening 110 is the charging section or chamber 116 that is positioned immediate adjacent the main ram travel section 114. The charging chamber 116 has an opening 120 whereby uncompressed waste material, such as scrap metal, can be introduced into the elongate opening 110 for compaction from a hopper 121.

The elongate opening 110 further includes a compression section or chamber 118 that is positioned proximate the charging chamber 116 so that the charging chamber 116 is interposed between the main travel section 114 and the compaction chamber 118. As will be discussed in greater detail below, uncompressed waste material is deposited into the charging chamber 116 and the baling ram 108 then urges the material into the compression section 118 thereby compressing the uncompressed waste material into a bale that has the approximate configuration and dimensions as the compaction chamber 118.

As is also shown in FIGS. 1A and 1B, the baling machine 100 further includes an ejector ram assembly 122 that received power from the hydraulic power unit 104 and includes an ejector linear actuator 126 and an ejector ram 128 attached to the ejector linear actuator 126. The ejector ram assembly 122 is positioned within an opening 130 formed in an ejector housing 132. The transverse opening 130 intersects the main opening 110 in the compaction chamber 118.

When the main ram assembly 102 is compacting the uncompacted waste material in the compaction chamber 118, the ejector ram 128 forms a portion of the wall of the compaction chamber 118. The side 134 of the compaction chamber 118 opposite the ejector ram 128 comprises a movable bale door 136. When compaction is complete, the movable bale door 136 is moved to an open position and the ejector ram assembly 122 urges the compacted bale 127 of waste material out of the compaction chamber 118.

The baling ram assembly 102, ejector ram assembly 122 and the movable door 136 are all under the control of a control system 140. The operation of the baling ram assembly 102, ejector ram assembly 122, bale door 136 and the machine 100 in general is consistent with the operation of the systems of this nature that are well understood in the art.

Figure 2:
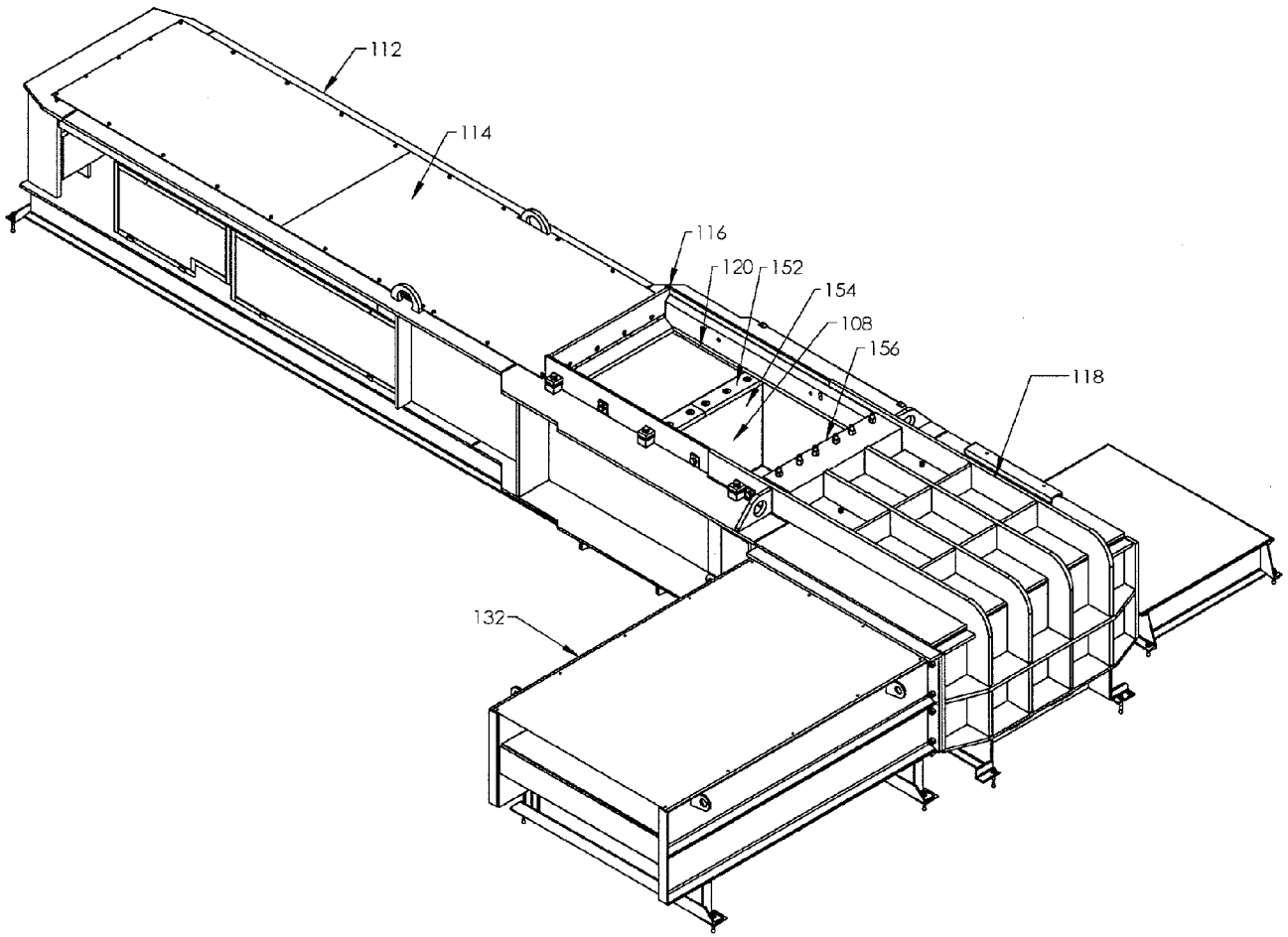
FIG. 2 is an isometric view of the waste material baler of FIGS. 1A and 1B.
Figure 3A:
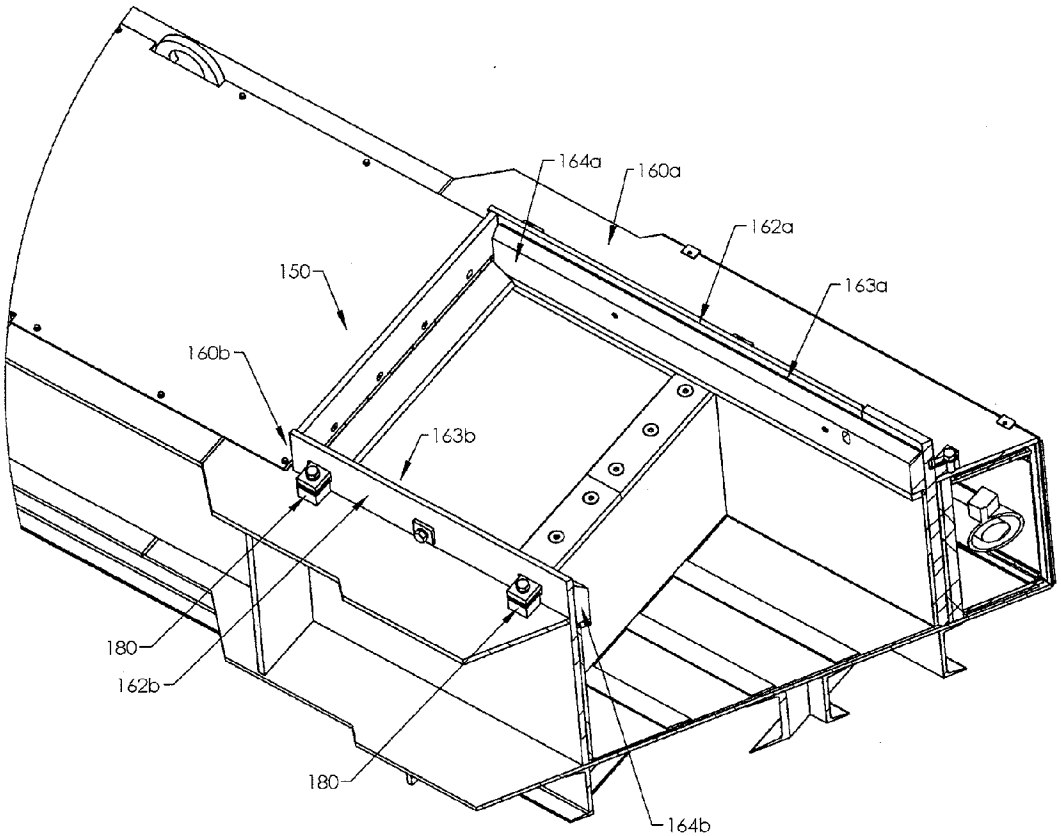
FIG. 3A is a partial perspective view of the waste material baler of FIG. 2 illustrating one embodiment of the vertical adjustment mechanism.
Figure 3B:
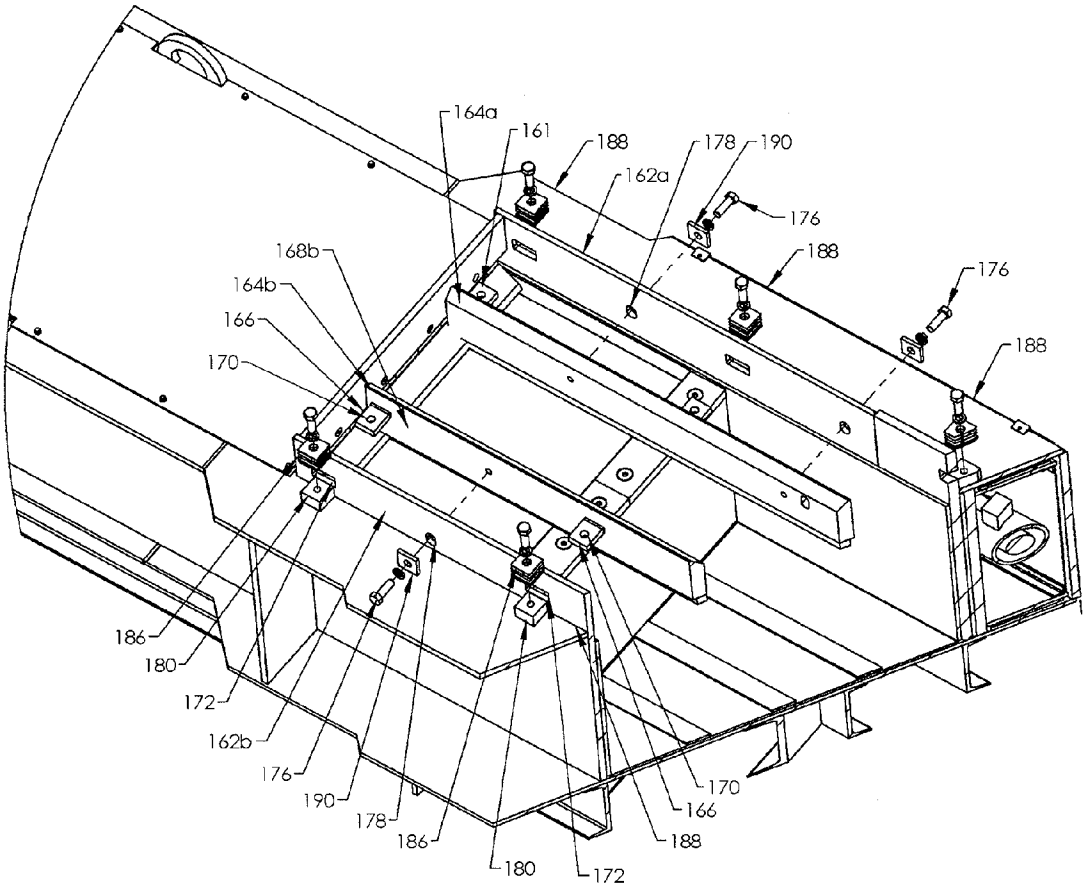
FIG. 3B is an exploded partial perspective view of the waste material baler of FIG. 2 illustrating one embodiment of the vertical adjustment mechanism.
Figure 4:
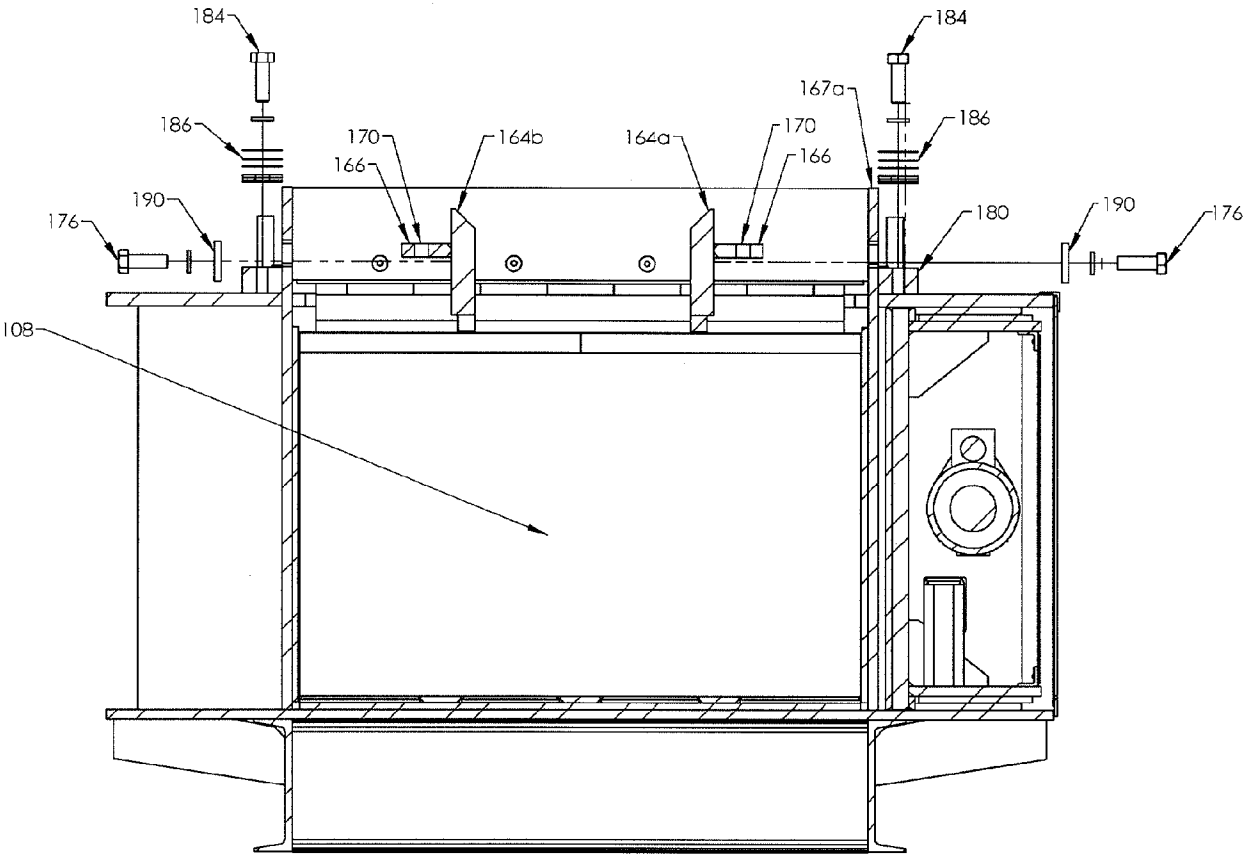
FIG. 4 is a front cross-sectional view of the waste material baler of FIG. 2 further illustrating one embodiment of the vertical adjustment mechanism.

Referring now to FIGS. 2-4, an adjustable vertical movement limiting assembly 150 will now be described in greater detail. As discussed above, the baling ram 108 is generally sized so as to have approximately the same cross-sectional area as the elongate opening 110. However, in the location of the opening 120 in the charging section 116, there is often sufficient space to permit vertical movement of the baling ram 108. This vertical movement can be the result of uncompacted waste material getting underneath the baling ram 108. The possibility of uncompacted waste material getting underneath the baling ram 108 increases as a result of wear occurring between the baling ram 108 and the bottom surface of the elongate opening 110 in the main housing 112 due to friction.

As shown in FIGS. 1A and 2, a knife member 152 is formed on an upper surface 154 of the baling ram 108. The knife member 152 comprises a reinforced band of metal that engages with a corresponding band of metal comprising a shear knife 153 formed on the distal surface 156 of the opening 120. The knife member 152 and the distal surface 156 of the opening 120 define a knife assembly that cuts off uncompressed material that is partially positioned within the charging chamber 116 so as to allow the material generally compressed within the charging chamber 116 to be compacted in the compaction chamber 118. Allowing vertical movement of the baling ram 108 could result in the knife assembly being damaged or could result in the baling machine 100 becoming jammed.

To address this issue, the vertical movement limiting assembly 150 is implemented on the machine 100. Referring more specifically to FIGS. 3A and 3B, the lateral sides 160*a*, 160*b* of the opening 120 include a vertically extending lip 162*a*, 162*b* that are coupled to the baler frame 101. Hold down members 164*a*, 164*b* are respectively positioned on an inner side 163*a*, 163*b* of the vertically extending lips 162*a*, 162*b*. The hold down members 164*a*, 164*b* are coupled to the lips 162*a*, 162*b* at one of range of vertical positions that is selected to limit the vertical movement of the baling ram 108 when the ram is adjacent the opening 120. As shown, the hold down members 164*a*, 164*b* in this embodiment extend the length of the opening 120, however, the overall length of the hold down members 164 can vary without departing from the spirit of the present invention.

As is also shown in FIGS. 3A, 3B and 4, a plurality of lateral flanges 166 are formed so as to extend outward from an outer side 168*a*, 168*b* of the hold down members 164*a*, 164*b*. The lateral flanges 166 include bolt openings 170. Preferably, the flanges 166 extend through openings 172 that are formed in the lips 162*a*, 162*b* so as to extend outward of the lips 162*a*, 162*b* with the bolt openings 170 exposed. The openings 172 preferably have a vertical dimension that is greater than the vertical dimension of the flanges 166 so as to permit the flanges 166 to move vertically within the opening 172 in the manner that will be described in greater detail hereinbelow.

As is also shown, the hold down members 164*a*, 164*b* also include one or more friction bolt openings 174 that receive friction bolts 176. Similarly, the lips 162*a*, 162*b* include corresponding friction bolt openings 178 that are elongate in the vertical direction that receive the friction bolts 176 and permit the friction bolts to engage with the friction bolt openings 176 in the hold down members 164*a*, 164*b* over a range of vertical positions in the manner that will be described in greater detail hereinbelow.

As is also shown in FIGS. 3A, 3B and 4, the lips 162*a*, 162*b* include laterally extending mounting blocks 180 that include threaded openings 182 that are adapted to receive bolts 184. The mounting blocks 180 are fixedly attached to the lips 162*a*, 162*b* at preferably a plurality of locations on each lip 162*a*, 162*b*, e.g., at least two places as shown. The flanges 166 of the hold down members 164*a*, 164*b* extend through the openings 172 so as to be positioned proximate the mounting blocks 180 so that the holes in the flanges 166 align with the holes 182 in the mounting blocks so that the bolts 184 can extend therethrough.

As is also shown in FIGS. 3A, 3B and 4, a plurality of shim plates 186 can be interposed between the flanges 166 and the mounting blocks 180 so as to vertically adjust the height of the hold down members 164*a*, 164*b*. When a desired vertical height of the hold down members 164*a*, 164*b* is achieved, an appropriate number of shim plates 186 can be positioned between the mounting block 180 and the flange 166 so as to retain the hold down members 164*a*, 164*b* at this desired height. Subsequently, the bolts 184 can be tightened so as to secure the hold down members 164*a*, 164*b* at this desired height. The mounting blocks 180, flanges 166 and shim plates 186 define a shim assembly 188 that permit easier vertical adjustment of the hold down members 164*a*, 164*b* in the manner that will be described in greater detail hereinbelow.

As is also shown, the friction bolts 176 also help to maintain the hold down members 164*a*, 164*b* at the desired height. More specifically, the friction bolts 176 extend through the elongate openings 178, via a washer 190, so as to be secured into the opening 174 in the hold down members 164*a*, 164*b*. The elongate opening 178 allow for a range of vertical positions of the friction bolt 176 with respect to the lips 162*a*, 162*b*.

As a result of the configuration of the friction bolts 176 and the shim assemblies 188, vertical adjustment of the hold down members 164*a*, 164*b* is greatly simplified particularly when performed to accommodate wear at the interface between the baling ram 108 and the bottom surface of the elongate opening 110. When wear does occur, the operator simply loosen the friction bolt 176 and removes the bolts 184 and pull the hold down members 164*a*, 164*b* inward. The operator can then remove the shim plates 186. This allows the hold down members 164*a*, 164*b* to rest on the upper surface of the baling ram 108 which is sitting on the bottom surface of the elongate opening 110.

Once the baling ram 108 is resting on the bottom surface, the hold down members 164*a*, 164*b* can then be positioned on top of the ram 108 and then moved outward so that the flanges 166 are positioned proximate the mounting blocks 180. Shim plates 186 can then be selected to as to space the gap between the flanges 166 and the mounting blocks 180. The friction bolts 176 and the bolts 184 can then be tightened to secure the hold down members 164*a*, 164*b* in position.

Alternatively, the operator may select a desired height, other than having the hold down members 164*a*, 164*b* resting on the baling ram 108, and tighten the friction bolts 176 to maintain the hold down members 164*a*, 164*b* at that height. Subsequently, the shims can be selected and the bolts tightened to secure the hold down members 164*a*, 164*b* in the desired orientation.

Vertical positioning of the hold down members 164*a*, 164*b* is thus simplified as a result of the combination of the shim assemblies 188 and the friction bolts 176. Further, the hold down members 164*a*, 164*b* simply have to be elongate members rather than custom fabricated or molded components. This further reduces the overall cost of the baling machine.

Although the foregoing description has shown, illustrated and described the fundamental novel features of the invention and methods of use thereof, it will be appreciate that various substitutions, modifications and changes to the apparatus and use thereof may be made by those skilled in the art without departing form the scope of the present invention. Hence, the present invention should not be limited to the foregoing description but should be defined by the appended claims.

What is claimed is:

1. A baling machine for baling uncompressed waste material, the baling machine comprising:

a baling ram housing having a floor and sidewalls that extend in a first direction from the floor of the baling ram housing defining an opening, and two vertically extending lips each having an inner side adjacent the opening and an outer side, wherein the baling ram housing includes a charging chamber and a compaction chamber, wherein the charging chamber includes an opening whereby uncompressed waste material can be introduced into the charging chamber, and wherein the two vertically extending lips are positioned on lateral sides of the opening into the charging chamber and each of the two vertically extending lips having a vertically elongate opening;

a baling ram assembly having a baling ram positioned within the housing, wherein the baling ram urges uncompressed material from the charging chamber into the compaction chamber so as to compress the uncompressed material into a bale;

an adjustable hold down assembly positioned adjacent the opening of the charging chamber, wherein the hold down assembly inhibits the baling ram from moving vertically upward in the charging chamber, wherein the hold down assembly includes at least one hold down member having an opening so as to be vertically adjustable with respect to the baling ram housing, wherein the at least one hold down member is coupled to the baling ram housing via at least one shim assembly that includes a plurality of shims and a hold down bolt that extends in a substantially vertical direction that is substantially parallel to the first direction of the baling ram housing and a friction bolt assembly having a friction bolt that extends in a substantially horizontal direction that is substantially perpendicular to the first direction of the bailing ram housing, wherein the at least one shim assembly and the friction bolt assembly are arranged so that removal of shims from the shim assembly allows the at least one hold down member to be positioned in a first position adjacent the baling ram when the baling ram is in the charging chamber so that the friction bolt assembly can be tightened to secure the at least one hold down member in the first position when at least some of the shims are removed, and wherein the friction bolt extends through the vertically elongate opening so as to couple with the opening of the at least one hold down member so that tightening of the friction bolt secures the at least one hold down member at a desired vertical orientation.

2. The machine of claim 1, further comprising an ejector ram assembly that is adapted to urge the bale in the compression chamber out of the compression chamber.

3. The machine of claim 2, wherein at least one side of the compression chamber comprises a door that can be opened to allow ejection of the bale from the compression chamber.

4. The machine of claim 1, wherein the at least one hold down member comprises a first and a second hold down members that are respectively positioned proximate the inner side of the two vertically extending lips of the baling ram housing.

5. The machine of claim 4, wherein the two vertically extending lips include openings extending therethrough and wherein mounting blocks are positioned adjacent the openings on the outer side of the two vertically extending lips.

6. The machine of claim 5, wherein the first and second hold down members include flanges that extend through the openings in the first and second vertically extending lips so as to be positioned proximate the mounting blocks and wherein the adjustable hold down assembly includes the flanges, the mounting blocks, one or more shims and a securing bolt so that the vertical orientation of the first and second hold down members can be adjusted relative to the vertically extending lips by positioning shims between the flanges and the mounting blocks.

7. A baling machine for baling uncompressed waste material, the baling machine comprising:

a baling ram housing that has sidewalls and a floor wherein the sidewalls extend in a first direction, wherein the baling ram housing is defining an opening and two vertically extending lips each having an inner side adjacent the opening and an outer side, wherein the baling ram housing includes a charging chamber and a compaction chamber, wherein the charging chamber includes an opening whereby uncompressed waste material can be introduced into the charging chamber, and wherein the two vertically extending lips are positioned on lateral sides of the opening into the charging chamber and each of the two vertically extending lips having a vertically elongate opening;

a baling ram assembly having a baling ram positioned within the housing, wherein the baling ram urges uncompressed material from the charging chamber into the compaction chamber so as to compress the uncompressed material into a bale;

an adjustable hold down assembly positioned adjacent the opening of the charging chamber, wherein the hold down assembly inhibits the baling ram from moving vertically upward in the charging chamber wherein the hold down assembly includes at least one hold down member having an opening so as to be vertically adjustable with respect to the baling ram housing, wherein the at least one hold down member is coupled to the baling ram housing via at least one shim assembly that includes a plurality of shims and a hold down bolt that extends in a substantially vertical direction that is substantially parallel to the first direction and a friction bolt assembly having a friction bolt that extends in a substantially horizontal direction that is substantially perpendicular to the first direction wherein the at least one shim assembly and the friction bolt assembly are arranged so that removal of shims from the shim assembly allows the at least one hold down member to be positioned so as to rest on the baling ram when the baling ram is in the charging chamber so that the friction bolt assembly can be tightened to partially secure the at least one hold down member in a first position and wherein shims can be selectively positioned into the shim assembly to retain the at least one hold down member in the first position when at least some of the shims are removed, and wherein the friction bolt extends through the vertically elongate opening so as to couple with the opening of the at least one hold down member so that tightening of the friction bolt secures the at least one hold down member at a desired vertical orientation.

8. The machine of claim 7, further comprising an ejector ram assembly that is adapted to urge the bale in the compression chamber out of the compression chamber.

9. The machine of claim 8, wherein at least one side of the compression chamber comprises a door that can be opened to allow ejection of the bale from the compression chamber.

10. The machine of claim 7, wherein the at least one hold down member comprises a first and a second hold down members that are respectively positioned proximate the inner side of the two vertically extending lips of the baling ram housing.

11. The machine of claim 10, wherein the two vertically extending lips include openings extending therethrough and wherein mounting blocks are positioned adjacent the openings on the outer side of the two vertically extending lips.

12. The machine of claim 11, wherein the first and second hold down members include flanges that extend through the openings in the first and second vertically extending lips so as to be positioned proximate the mounting blocks and wherein the adjustable hold down assembly includes the flanges, the mounting blocks, one or more shims and a securing bolt so that the vertical orientation of the first and second hold down members can be adjusted relative to the vertically extending lips by positioning shims between the flanges and the mounting blocks.

13. An adjustable hold down assembly for a baling machine for baling uncompressed waste material, the baling machine having a baling ram housing having a floor and sidewalls that extend in a first direction from the floor, the baling ram housing defining an opening and two vertically extending lips each having an inner side adjacent the opening and an outer side, wherein the baling ram housing includes a charging chamber and a compaction chamber, wherein the charging chamber includes an opening whereby uncompressed waste material can be introduced into the charging chamber, and wherein the two vertically extending lips are positioned on lateral sides of the opening into the charging chamber and each of the two vertically extending lips having a vertically elongate opening, and a baling ram assembly having a baling ram positioned within the housing, wherein the baling ram urges uncompressed material from the charging chamber into the compaction chamber so as to compress the uncompressed material into a bale, the hold down assembly being positioned adjacent the opening of the charging chamber, wherein the hold down assembly inhibits the baling ram from moving vertically upward in the charging chamber wherein the hold down assembly includes at least one hold down member having an opening so as to be vertically adjustable with respect to the baling ram housing and wherein the at least one hold down member is coupled to the baling ram housing via at least one shim assembly that includes a plurality of shims and a hold down bolt that extends in a substantially vertical direction that is substantially parallel to the first direction and a friction bolt assembly having a friction bolt that extends in a substantially horizontal direction that is substantially perpendicular to the first direction wherein the at least one shim assembly and the friction bolt assembly are arranged so that removal of shims from the shim assembly allows the at least one hold down member to be positioned in a first position adjacent the baling ram when the baling ram is in the charging chamber so that the friction bolt assembly can be tightened to secure the at least one hold down member in the first position when at least some of the shims are removed, and wherein the friction bolt extends through the vertically elongate opening so as to couple with the opening of the at least one hold down member so that tightening of the friction bolt secures the at least one hold down member at a desired vertical orientation.

14. The hold down assembly of claim 13, wherein the at least one hold down member comprises a first and a second hold down members that are respectively positioned proximate the inner side of the two vertically extending lips of the baling ram housing.

15. The assembly of claim 14, wherein the two vertically extending lips include openings extending therethrough and wherein mounting blocks are positioned adjacent the openings on the outer side of the two vertically extending lips and wherein the first and second hold down members include flanges that extend through the openings in the first and second vertically extending lips so as to be positioned proximate the mounting blocks and wherein the adjustable hold down assembly includes the flanges, the mounting blocks, one or more shims and a securing bolt so that the vertical orientation of the first and second hold down members can be adjusted relative to the vertically extending lips by positioning shims between the flanges and the mounting blocks.

* * * * *